US005472281A

United States Patent [19]

Phelps

[11] Patent Number: 5,472,281

[45] Date of Patent: Dec. 5, 1995

[54] SELF CLOSING PROTECTIVE RECEPTACLE AND METHOD OF MAKING THE SAME

[76] Inventor: Paul E. Phelps, 5 Bronson Ave., Scarsdale, N.Y. 10583

[21] Appl. No.: 257,344

[22] Filed: Jun. 9, 1994

[51] Int. Cl.[6] ..... B65D 33/24

[52] U.S. Cl. ..... 383/43; 150/150

[58] Field of Search ..... 383/43, 66, 903; 150/150

[56] References Cited

U.S. PATENT DOCUMENTS

| | | | |
|---|---|---|---|
| Re. 24,166 | 6/1956 | Stiller | 150/150 |
| 820,067 | 5/1906 | Richardson | 383/43 X |
| 2,720,903 | 10/1955 | Pickren . | |
| 3,063,487 | 11/1962 | Mullin . | |
| 3,176,743 | 4/1965 | Bundy | 383/43 X |
| 3,272,248 | 9/1966 | O'Farrell . | |
| 5,069,261 | 12/1991 | Ji . | |

FOREIGN PATENT DOCUMENTS

| | | | |
|---|---|---|---|
| 599184 | 3/1948 | United Kingdom | 383/43 |
| 797040 | 6/1958 | United Kingdom | 383/43 |

*Primary Examiner*—Jes F. Pascua
*Attorney, Agent, or Firm*—Darby & Darby

[57] ABSTRACT

A self closing receptacle is provided comprising an elongated flexible tube having a pair of ends. The tube has a central portion intermediate its ends, the central portion having an exterior surface with a first convex curvature transverse to a direction of elongation of the flexible tube. Each one of the pair of ends is crimped together to seal the central portion. The crimped ends are arranged to align with one another through a plane such that the exterior surface has a second convex curvature in the direction of elongation outside of the plane, and a concave curvature in the direction of elongation within the plane. The central portion has an axially directed slot in the plane through the concave curvature such that the central portion bows outward and the slot deforms in response to squeezing pressure applied along the crimped ends to permit insertion or removal of an object through the slot. A method of making the foregoing receptacle is also provided.

6 Claims, 2 Drawing Sheets

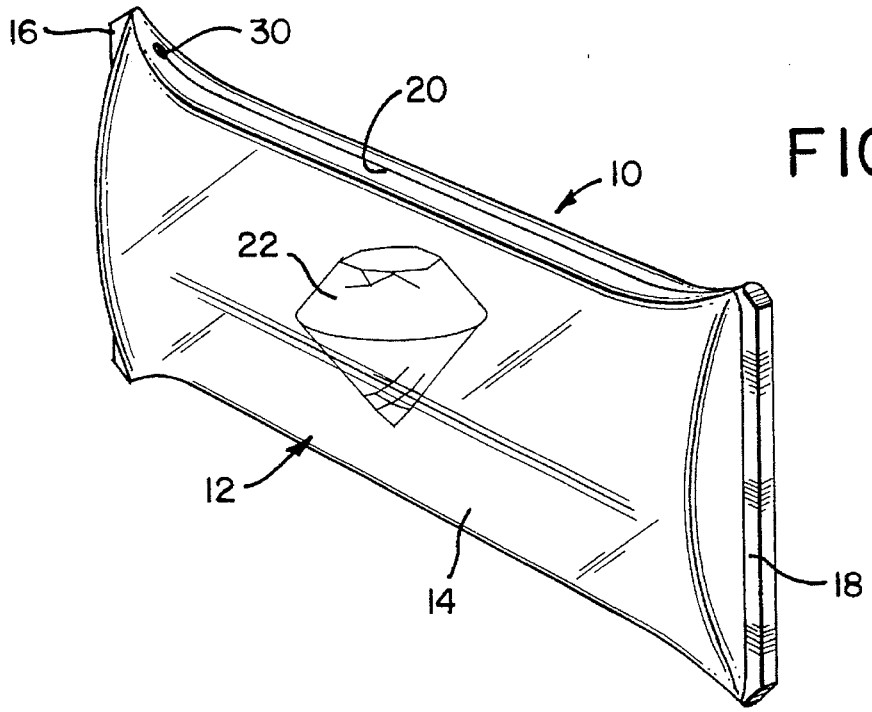
FIG. 1
FIG. 2
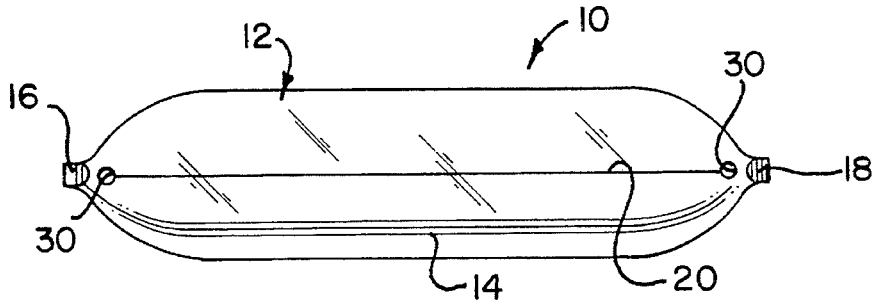
FIG. 3
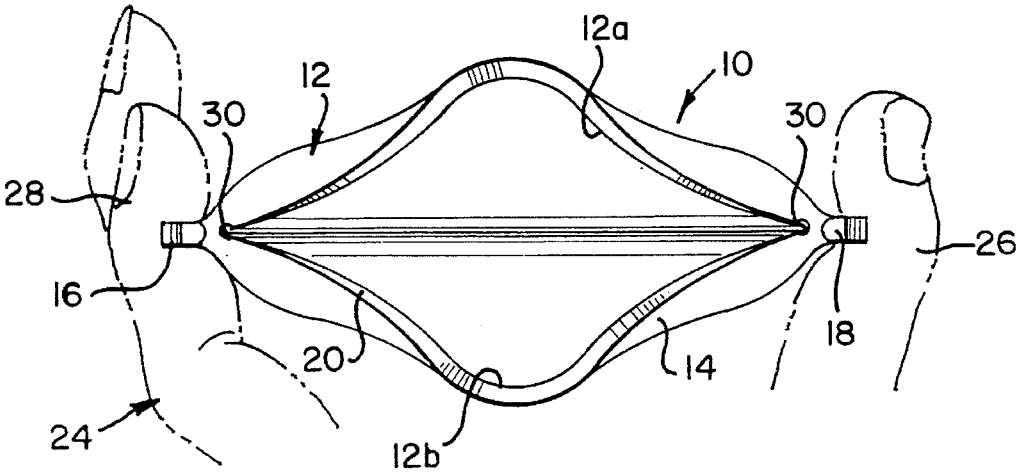

FIG. 4
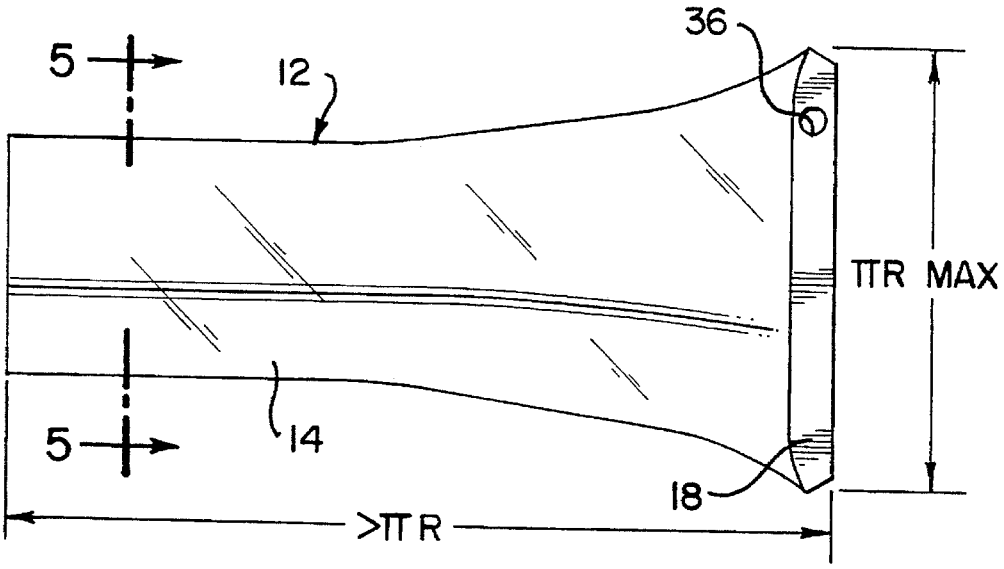
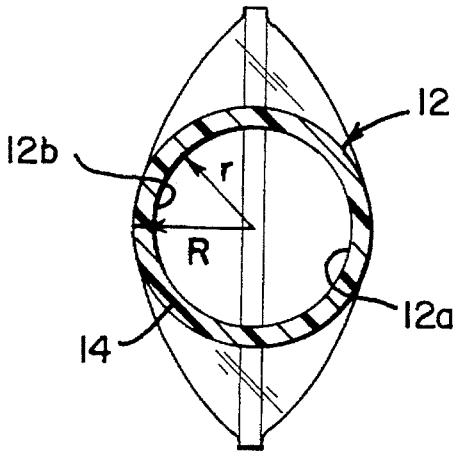
FIG. 5

SELF CLOSING PROTECTIVE RECEPTACLE AND METHOD OF MAKING THE SAME

FIELD OF THE INVENTION

The present invention relates generally to devices for containing small objects and more particularly to a receptacle having soft thick walls to protect objects therein from sharp blows or pressure.

BACKGROUND OF THE INVENTION

In the jewelry business, precious and semiprecious stones are typically stored in paper envelopes or in small plastic or polyethylene bags. Such containers do not protect their contents from sharp blows or pressure nor do they provide one-handed access to their contents.

Self closing purses for holding coins and ash, including those that are operable with one hand, are known in the art. Coin purses have been constructed from two aligned sheets of flexible plastic material that are sealed around their edges. In one design, a slot is oriented along one margin of the coin purse, for example, the top, while the other three edges are sealed together. U.S. Pat. No. 2,720,903 discloses an ash receptacle formed from two sheets of plastic material sealed along three sides. The top or fourth side remains unsealed and has a bulbous portion formed therealong to assist in maintaining the receptacle closed. U.S. Pat. No. 3,272,278 teaches a plastic bag comprising two sheets of material that are similarly sealed along three sides. The bag described therein has stays to hold the sheets closely together at adjacent unsealed edges to ensure a fairly tight closing.

U.S. Pat. No. 3,063,487 discloses a molded plastic change purse construction having a thickened beaded portion formed at its access opening. This thickened portion is adapted to direct coins contained within the purse toward the extremities of the purse opening. The extremities of the purse opening are said to be at a location where the purse closure has the greatest resilient closing force. Thus, the beaded portion assists in keeping the purse in closed.

Common to all of these designs is a sealing member to keep the container closed. It would be desirable to have a self closing receptacle that does not require a sealing member to retain objects of three significant dimensions therein. It would also be desirable to have a receptacle that protects its contents from sharp blows or pressure, provides one-handed access to its contents and has a rigidly bulbous internal cavity.

OBJECTS AND SUMMARY OF THE INVENTION

It is an object of the present invention to provide a self closing receptacle that protects objects contained therein from sharp blows or pressure.

It is a further object to provide a protective receptacle that is operable with one hand.

It is yet a further object to provide a receptacle that permits objects contained therein to be manipulated and viewed with the receptacle in a closed position.

It is still another object to provide a receptacle that is easy to manufacture.

These and other objects are achieved according to the present invention by a self closing receptacle comprising a hollow flexible tube having a pair of ends, the tube including a central portion intermediate the pair of ends, each one of the ends being pinched together so as to seal the central portion, the pinched ends being generally parallel to one another, and the central portion having an axially directed slot such that the central portion will bow outward and the slot will deform in response to pressure applied along the pinched ends to permit insertion or removal of an object through the slot. The receptacle advantageously has convex walls to protect objects contained therein from externally applied forces. As a preferred feature, the receptacle has a hole delimiting the axial slot. The central portion of the tube may have a substantially circular cross section of radius r so that objects smaller than 2 r in any dimension can be contained within the receptacle and move freely about.

A method of making a self closing receptacle according to the present invention comprises the steps of pinching one end of a hollow flexible tube to form a first pinched end, pinching another end of the tube to form a second pinched end that is generally parallel to the first pinched end, sealing each of the first and second pinched ends, and forming an axial slot in the tube that is intermediate to the pinched ends, so that the receptacle will open along the slot in response to applied pressure. An additional step performed in a preferred embodiment is the step of forming holes in the tube so as to define each end of the slot.

BRIEF DESCRIPTION OF THE DRAWINGS

FIG. 1 is a perspective view of a receptacle formed in accordance with the present invention having an object contained therein;

FIG. 2 is a top view of the receptacle of FIG. 1;

FIG. 3 is the receptacle of FIG. 1 shown in an open position;

FIG. 4 is a diagram of a receptacle being formed in accordance with the method of the present invention;

FIG. 5 is a cross section taken along line 5—5 of FIG. 4.

DETAILED DESCRIPTION OF THE PREFERRED EMBODIMENTS

By way of overview and introduction, there is seen in FIG. 1 a perspective view of a receptacle 10 formed in accordance with the present invention. The receptacle includes an elastically rigid hollow tube 12 having a substantially circular central portion 14 of inner radius r. Tube 12 has a pair of pinched ends 16,18 that seal the central portion. The receptacle further has an axial slot 20 intermediate the pinched ends (see FIG. 2). The slot deforms in response to pressure applied to pinched ends 16,18 so as to permit insertion or removal of an object 22 through the slot. Because central portion 14 may have an inner radius r rather than being flat, objects up to 2 r in any dimension can be contained therein and move freely about, it being understood that inner radius r is selected in accordance with the size of the object to be contained. Thus, a receptacle might be selected of a size such that the culet (point) of a stone sticks into soft, thick walls 12*a*,*b* (see FIGS. 3 and 5).

Referring to now FIG. 3, there is seen the receptacle 10 of FIG. 1 in an open position due to pressure applied to pinched ends 16,18 by a hand 24. The receptacle is shown between a thumb 26 and a forefinger 28, however, proportionally larger receptacles could be held differently. By applying pressure between the thumb and forefinger, as by squeezing, slot 20 deforms along the axis of tube 12 and a pair of walls 12*a*,*b* bow outward to permit insertion or removal of objects 22 up to 2 r in size through the slot. Preferably, the slot is demarcated by a pair of apertures 30. The apertures, like the slot, are intermediate pinched ends 16, 18.

The receptacle of the present invention is well suited to protecting objects 22 contained therein. This is of significant importance where crystals, precious or semiprecious stones, enamel or other delicate objects are to be stored or transported. As best seen in FIG. 5, tube 12 has walls 12*a,b* of a thickness equal to R–r sufficient to diffuse external forces for impacting central portion 14. The tube can be made of a transparent, plastic material that allows, for example, the brilliance of precious stones or other objects to show through the receptacle for display purposes without having to open the receptacle. The tube also preferably has a high elastomer to plasticizer ratio so that the tube walls cradle objects 22 from sharp blows, such as when the receptacle is inadvertently dropped, pressed or crushed. When receptacle 10 is made of vinyl, it provides a greater coefficient of static friction than, for example, polyethylene which advantageously assists in restricting motion of objects 22 within the receptacle. Vinyl may be provided as a soft or compliant material. Hard and potentially brittle precious objects such as, for example, diamonds, rubies, and emeralds, as well as semi-precious stones such as amethyst and garnet, are advantageously protected from external forces by the thick soft walls 12*a,b* of the receptacle. The soft, convex walls of tube 12 provide a natural surface for diffusing external forces from central portion 14 and for resisting collapse of the internal cavity. The exterior surface of the receptacle 10 defines first and second convex surfaces. As perhaps best seen in FIG. 5, which is taken in a direction transverse to the axis of the tube 12, that is, in the direction of elongation of the tube 12, the receptacle 10 has a first convex curvature exterior surface about the central portion 14. The second convex curvature surface extends in the direction of elongation of the tube 12, and results from the pinching or crimping of the ends 16,18, as illustrated in FIG. 2. This is of special importance where object 22 is a stone with a multitude of corner facets 32 on its bezel and pavilion that might chip if the girdle 34 of the stone were subjected to an undiffused applied force. The naturally convex walls assume their native stance upon release of any pressure that may be applied to pinched ends 16,18. The thickness and elasticity of the walls contribute to the native restoring force.

The receptacle can also pick up objects 22 by allowing the receptacle to close around the object.

With further reference to FIGS. 4 and 5, a method of making receptacle 10 is now described. A section of flexible tubing is preferably cut at a right angle to the tube axis to form a cylindrical tube 12. This tubing has an inner radius r and an outer radius R (FIG. 5). While the choice of tubing (rigid, flexible or semi-rigid) and its thickness is application specific, a wide range of suitable materials are available from Ain Plastics, Inc. of Mount Vernon, N.Y., as shown in the Ain Plastics catalog. It should be understood that the radius of the receptacle to be used for a given object 22 may be related to the size of the object to be stored so that there is a minimum of wasted space or bulk. Smaller receptacles can be stored or sub-sorted within larger receptacles. In the Figures, the section of tubing is shown having an axial length greater than $\pi R$ in the direction of elongation so that pinched ends 16, 18, which define a pair of side walls of the receptacle, are necessarily shorter than the axial length of the receptacle.

Receptacle 10 is formed, in part, by pinching both ends 16,18 of tube 12. In FIG. 4, a first pinched end 16 is shown. Pinching or crimping of the ends 16,18 may be accomplished by a vice or otherwise. As with the first pinched end, the opposite end of the tube is pinched to form a second pinched end 18. As shown in FIG. 2, pinched end 18 is preferably formed generally parallel to pinched end 16. Preferably, ends 16 and 18 are pinched simultaneously.

So that pinched ends 16,18 retain their pinched posture, they are sealed together, as by heating with a heat gun or torch, to melt walls 12*a,b* together. There are, of course, other ways of sealing the ends of tube 12 that should be considered to be within the scope of the present invention.

Receptacle 10 is preferably permitted to cool after the heating step. This forms a pinched and sealed tubular structure with stress points that relax in this configuration. Thus, even after one margin of the receptacle is cut to form a slot 20, the receptacle will resist opening due to the memory effect of the pre-stressed receptacle walls. This advantageously eliminates the need for additional sealing members and assists in resisting dirt and moisture from entering the receptacle.

A slot 20 is then formed in central portion 14 of tube 12. The slot is preferably formed on a margin of tube 12 such that it is oriented generally planar to pinched ends 16,18 for ease of operation of the receptacle. As previously described, the pinched ends 16,18 impart a second convex curvature to the receptacle 10 in the direction of elongation (see FIG. 2). Further, a concave curvature is formed in the receptacle 10, in the direction of elongation, between the central portion 14 and each of the pinched ends 16, 18. As illustrated in FIGS. 1–3, the slot is generally disposed in a plane through the concave curvature. The slot may be marked, as by a colored line, to identify the opening in the receptacle. Optionally, holes 30 are formed in the tube to demarcate each end of the slot. These holes serve as strain reliefs to prevent slot 20 from elongating toward pinched ends 16,18 after repeated use.

The receptacle of the present invention may include an aperture 36 (FIG. 4). The receptacle may be hung on a pin through the aperture for display or storage. Alternatively, a string or rubber band may be inserted through the aperture for hanging a single receptacle or grouping several receptacles by the string or rubber band. Where aperture 36 takes the form of a slot (not shown), a strap may be attached for transporting objects 22 in the receptacle on a body appendage such as a wrist or ankle. Alternatively, VELCRO material may be adhered to a surface of the receptacle for display or storage purposes.

While the present receptacle has been described for use as a self-closing jewelry container, which is the presently most preferred application, the receptacle may be useful with other objects such as screws, beads, sequins, or subassemblies and in other applications requiring a self-closing article, such as a self-locating mask or cover. And while receptacle 10 is shown in FIG. 3 as operable with one hand, it is to be understood that larger receptacles which do not fit in one hand would nevertheless exhibit the easy to open/close property of the present design and have convex walls that resist collapsing. From the foregoing description it will be clear that the present invention may be embodied in other specific forms without departing from the spirit or essential characteristics thereof. The presently disclosed embodiment is therefore to be considered as illustrative and not restricted, the scope of the invention being indicated by the appended claims.

I claim:

1. A self closing receptacle, comprising:

an elongated flexible tube having a pair of ends;

said tube including a central portion intermediate said pair of ends, said central portion having an exterior surface with a first convex curvature transverse to a direction of elongation of said flexible tube;

each one of said pair of ends being crimped together so as to seal said central portion and arranged so that said crimped ends are aligned with each other through a plane so that said exterior surface has a second convex curvature in the direction of elongation outside of said plane and a concave curvature in the direction of elongation within said plane; and said central portion having an axially directed slot generally in the plane through said concave curvature such that said central portion bows outward and said slot deforms in response to squeezing pressure applied solely along said crimped ends to permit insertion or removal of an object through said slot, said flexible tube being stressed due to said crimped ends so as to impart a memory state in which the slot resists opening absent said squeezing pressure.

2. A self closing receptacle as in claim 1, wherein said axially directed slot is oriented generally coplanar to said crimped ends.

3. A self closing receptacle as in claim 1, wherein said axial slot is delimited by a round hole at either end.

4. A self closing receptacle as in claim 1, wherein said central portion of said tube has a substantially circular cross section having a radius r.

5. A self closing receptacle as in claim 4, wherein said central portion of said tube is at least $\pi r$ in axial length.

6. A self closing receptacle as in claim 1, wherein said hollow flexible tube has convex walls to protect objects contained therein from externally applied forces.

* * * * *